United States Patent [19]

Neal

[11] Patent Number: 4,925,341

[45] Date of Patent: May 15, 1990

[54] REPLACEABLE CEMENT-TROWEL BLADE TRAILING EDGE

[76] Inventor: Harold L. Neal, 5209 Culbreath Rd., Brooksville, Fla. 34601

[21] Appl. No.: 325,940

[22] Filed: Mar. 20, 1989

[51] Int. Cl.[5] ..... E01C 19/22

[52] U.S. Cl. ..... 404/112; 404/118

[58] Field of Search ..... 404/112, 118; 15/235.4; 51/177

[56] References Cited

U.S. PATENT DOCUMENTS

| | | | |
|---|---|---|---|
| 1,005,208 | 10/1911 | Heltzel | 15/235.4 |
| 2,556,983 | 6/1951 | Root | 404/112 |
| 2,662,454 | 12/1953 | Whiteman | 404/112 |
| 2,865,269 | 12/1958 | McMillan | 404/112 |
| 3,375,766 | 4/1968 | Zochil | 404/112 |
| 3,683,761 | 8/1972 | Babic | 404/112 |
| 4,848,959 | 7/1989 | Morrison | 404/112 |
| 4,859,115 | 8/1989 | Morrison | 404/112 |

*Primary Examiner*—Jerome W. Massie, IV
*Assistant Examiner*—Matthew Smith

[57] ABSTRACT

A motorized rotary cement trowel is provided with a detachable trowel blade with a detachable trailing edge having a variety of forms of trailing-edge configurations and optional quick-disconnect means for attachment of the detachable trailing edge to the cement-trowel blade.

18 Claims, 2 Drawing Sheets

REPLACEABLE CEMENT-TROWEL BLADE TRAILING EDGE

TECHNICAL FIELD

This invention relates to cement-trowel blades and in particular to a motorized rotational cement-trowel blade with a replaceable trailing edge.

RELATED TECHNOLOGY

Motorized cement trowels generally are comprised of four trowel blades that are rotated by a trowel engine or motor. The leading edge in the direction of rotation is bent upwards to prevent it from digging into cement that is being troweled. Initially, when the cement is most wet, the rotating blades are rotated while being held in a flat condition parallel to the surface of cement being troweled. This is known as floating. Then as the cement becomes harder and drier, the blades are turned to increasing angles between the blade surface and the cement surface. This is called finishing. Combination trowel blades are employed to achieve both the floating and the finishing with such machines.

Motorized cement trowels generally are provided also with an adjustment wheel knob linked mechanically to a geared rotor wheel for varying the angle of the blades as they are being rotated. In handle-operated models, the adjustment wheel is on a handle generally. In riding models, the adjustment wheel may be positioned at various convenient locations.

The trowel blades do not wear out rapidly at their front sections because there is more contact surface of the blade when the blades are in a flat condition for floating and the wet cement is less abrasive than the drier cement. However, when the blades are tipped upwards at the front, only a small portion of the aft section of the blades is in contact with the cement and the cement is highly abrasive as it dries when finishing cement troweling. A great portion of troweling is finishing under these high-wear conditions. As a result, the entire trowel blade must be re-worked or replaced often to compensate for wear of mostly the aft section of blades. Reworking and replacing blades is highly expensive for both the material and the labor time required.

Various forms of attachable boots have been attempted but abandoned because an expensive boot section had to be discarded when only the trailing edge was worn.

There is a great need, therefore, for a replaceable trowel blade with a conveniently and reliably replaceable trailing edge. This invention fills this need and other in an improved replaceable cement-trowel blade.

SUMMARY OF THE INVENTION

One object of this invention is to provide a cement trowel blade with a replaceable trailing-edge.

Another object of this invention is to provide a replaceable trailing edge of a cement-trowel blade with high use-life.

Another object of this invention is to provide a replaceable trailing edge of a cement-trowel blade with improved cement-finishing characteristics.

Another object of this invention is to provide a cement-trowel blade with a wide selection of attachable trailing edges for various and different types of cement finishing.

Another object of this invention is to provide a cement-trowel blade that is attachable to a wide variety of motorized trowel machines.

Anther object of this invention is to provide a trowel blade with a trailing-edge easily attachable and detachable with a quick-disconnect means.

Still another object of this invention is to provide a conventional trowel blade with a means for attachment of a replaceable trailing-edge section.

In this invention, a combination trowel blade is provided with a replaceable trailing-edge section that is attachable to the aft edge of a trowel blade to accomplish these and other objectives.

DESCRIPTION OF PREFERRED EMBODIMENT

Figure 1:
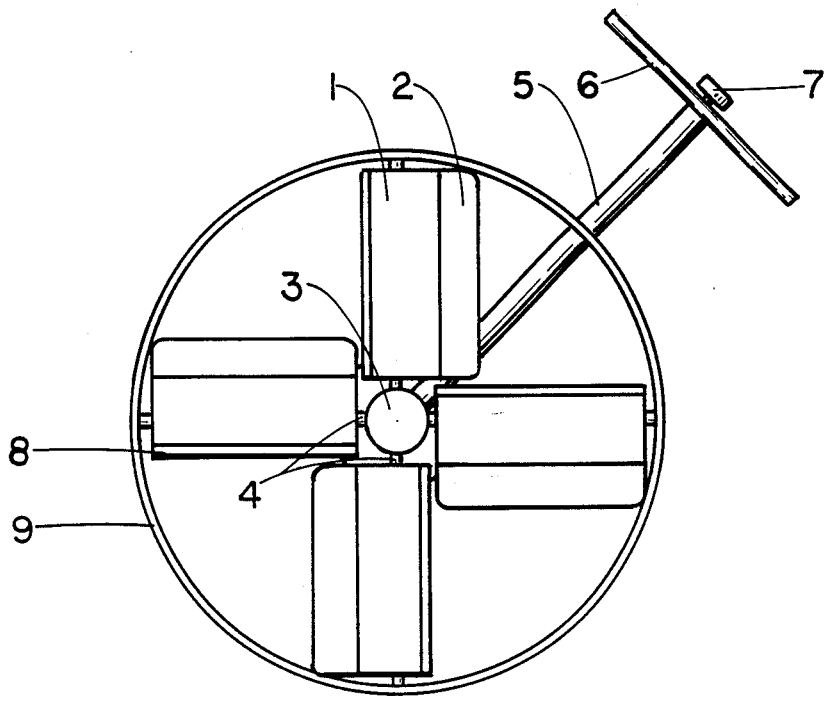
FIG. 1 is a bottom view of a conventional motorized rotational troweling machine with this invention of replaceable trowel blades attached.

Referring to FIG. 1, a replaceable cement-trowel blade 1 is provided with a replaceable trailing edge 2. The replaceable trowel blade 1 is attachable to a conventional motorized gear rotor 3 by attachment shafts 4.

This is a bottom view that blocks view of an engine that provides rotational power to the motorized gear rotor 3 in conventional practice. Typically, a handle shaft 5 with a handle 6 houses a control shaft that can be rotated by blade-control knob 7 to cause the blade 1 and trailing edge to be either flat against a cement surface being troweled or for an upwardly-bent leading edge 8 to be raised. A circular guard 9 is positioned at the outside diameter of rotation of the blades 1 to prevent their contact with outside objects when the blades are being rotated. There are also conventional riding models of motorized rotary trowel blades that function similarly in relation to the rotational features and adjustment of the angle of the blade. This invention is related to the structure of the blade, not the rotary mechanism or adjustment of the angle of the blades in relation to the surface of cement being troweled.

Figure 2:
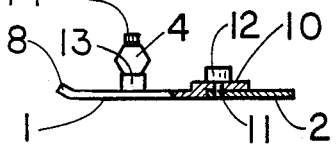
FIG. 2 is an end view of this invention employing a quick-disconnect means.

Referring to FIG. 2, the attachable trailing edge 2 is attached to a raisedstep aft portion 10 of the replaceable trowel blade 1 by means of a quickdisconnect bolt shaft 11 and quick-disconnect bolt head 12. A blade attachment boss 13 is attachable to attachment shaft 4 by shaft bolts 14.

Figure 3:
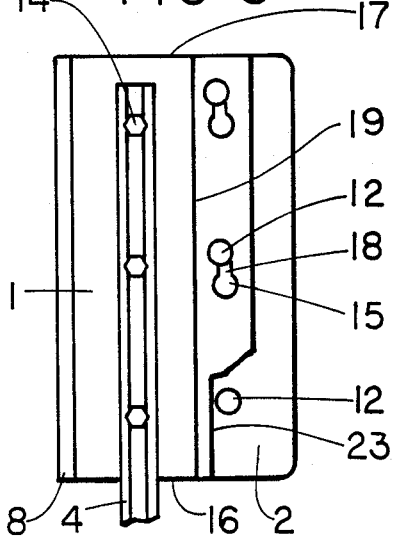
FIG. 3 is a top view of the embodiment of the invention illustrated in FIG 2.

Referring to FIG. 3, attachment of the replaceable trailing edge 2 to the blade 1 is achieved by inserting bolt head 12 through bolt-head orifice 15 when the trailing edge 2 is off-centered inwardly from a blade inside edge 16 and then forcibly sliding the trailing edge 2 towards a blade outside edge 17 and thereby causing the bolt shafts 11 to enter angled quick-disconnect channels 18. Quick-disconnect channels 18 are at an angle preferably less than 4 degrees from parallel to trowel-blade aft edge 19, such that travel of the trailing edge 2 and, therefore, travel of the bolt shaft 11 outwardly towards the blade outside edge 17 causes the trailing edge 2 to move in the direction of the blade aft edge 19.

Figure 4:
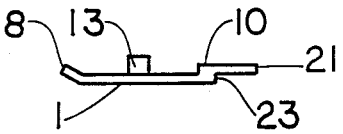
FIG. 4 is an end view of the attachable blade illustrated in FIGS. 2 and 3 but without the trailing-edge section attached.

Referring to FIG. 4, the trowel blade 1 is illustrated from an end view without the attachment shaft 4 and without the bolt heads 12.

Figure 5:
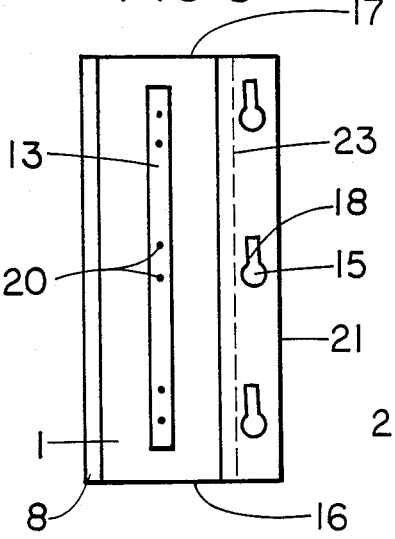
FIG. 5 is a top view of the attachable blade illustrated in FIG. 4 without the trailing-edge section attached.

Referring to FIG. 5, the trowel blade 1 is illustrated from a top view without the attachment shaft 4 and without the bolt heads 12. The angled quick-disconnect channels 18 can be viewed more thoroughly without the bolt heads 12. The shaft boss can be provided with select fastener orifices 20 for various models of motorized trowels and attachment shafts 4. A raised-step aft edge 21 is extended sufficiently to hold the trailing edge rigidly in combination with the bolt shaft 11 and the bolt head 12.

Figure 6:
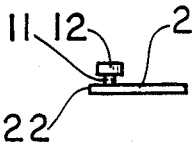
FIG. 6 is an end view of a trailing-edge section of the embodiment of the invention illustrated in FIGS. 2 and 3.

Referring to FIG. 6, the bolt shaft 11 and head 12 are illustrated extending vertically from the top surface of the trailing edge 2 separately in an end view.

Figure 7:
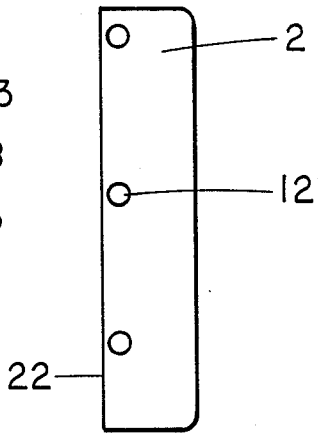
FIG. 7 is a top view of the trailing-edge section illustrated in FIG. 6.

Referring to FIG. 7, a top view of the trailing edge 2 illustrates the bolt heads 12 before they are inserted into bolt-had orifices 15.

Referring to FIGS. 2–7, the action of the quick-disconnect is such that a trailing-edge front 22 is caused to come in contact with a raised-step contact wall 23 by movement of the trailing edge in the direction of the blade outside edge 17. Rotation of the blade 1 causes the trailing edge 2 to travel outwardly also, such that operation of the motorized trowel causes the blades to increase in rigidness of attachment, rather than to become loose from working conditions. Disconnecting the trailing edge 2 from the blade 1 is accomplished by tapping the trailing edge inwardly towards the geared rotor 3 and then sliding it further inwardly until the bolt heads 12 are in line with the bolt-head orifices 15 and the trailing edge 2 can be removed.

Figure 8:
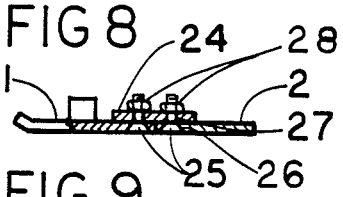
FIG. 8 is an end view of an embodiment of the invention adapted to utilize conventional trowel blades that have been suitably modified.
Figure 9:
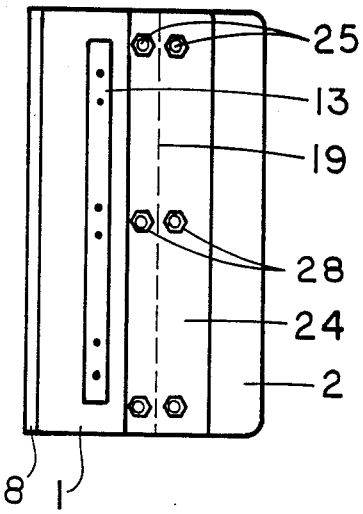
FIG. 9 is a top view of the embodiment illustrated in FIG. 8.

Referring in FIGS. 8 and 9, a means for attachment of the trailing edge 2 to the trowel blade 1 with less machinery required for making the components is shown in assembly end and top views. A flat connector member 24 is overlayed on the top surfaces of the blade 1 and the trailing edge 2. Flat-head connector bolts 25 are then inserted into countersunk bolt-head orifice 26 and bolt orifice 27 and tightened against fastener nut 28.

Figure 10:
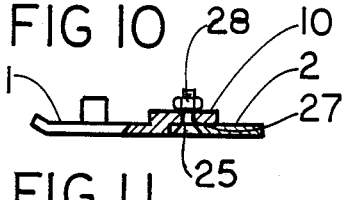
FIG. 10 is an end view of an embodiment of the invention employing a conventional flat-heat bolt, rather than a quick-disconnect means for attachment of the trailing-edge section.
Figure 11:
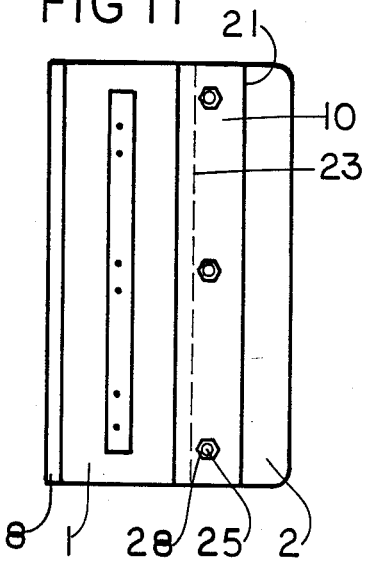
FIG. 11 is a top view of the embodiment of the invention illustrated in FIG 10.

Referring to FIGS. 10 and 11, a means for attachment of the trailing edge 2 to the trowel blade 1 with few fastener elements is shown in assembly end and top views. The raised-step aft portion 10 is provided with bolt orifices 27 and the trailing edge 2 is provided with countersunk bolt-head orifices 27. Flat-head bolts 25 are then inserted through these fastener orifices and a fastener nut 28 is tightened against the raised-step aft portion 10.

Figure 12:
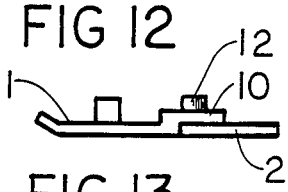
FIG. 12 is an end view of an embodiment of the invention with a modified means for tightening the quick-disconnect of the trailing edge section to the trowel blade.
Figure 13:
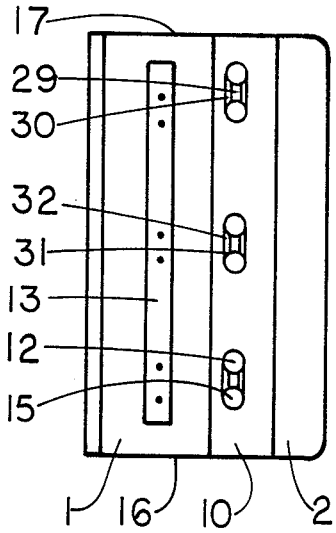
FIG. 13 is a top view of the embodiment illustrated in FIG. 12.
Figure 14:
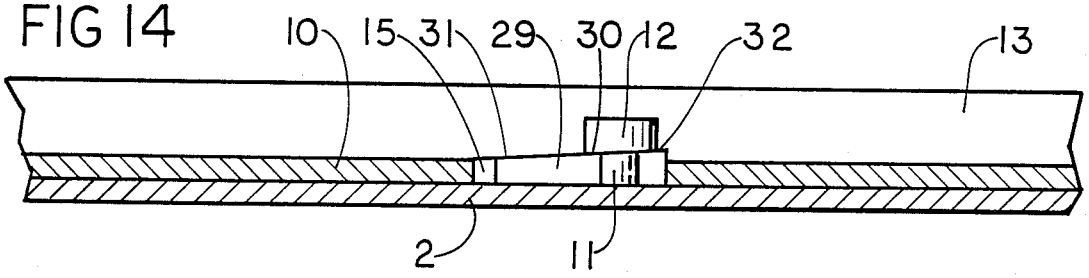
FIG. 14 is a sectional view of the means for tightening the quick-disconnect feature illustrated in FIGS. 12 and 13.

Referring to FIGS. 12, 13 and 14. the quick-disconnect means is provided with a parallel bolt-shaft orifices 29 with walls parallel to the raised-step contact wall 23 and the trailing-edge front 22. Sloped orifice edges 30 at the sides of the parallel bolt-short orifices 29 provide a tightening effect when quick-disconnect bolt head 12 is inserted into bolt-head orifice 15 and the quick-disconnect bolt shafts 11 are pressured selectively in the direction of the blade outside edge 17 by pressure applied against the trailing edge 2. This causes the quick-disconnect bolt head 12 to travel from a low end 31 to a high end 32 of the sloped orifice edges and thereby tighten the bolt head 12 with respect to the trailing edge 2 to which the bolt shaft 11 is connected. Rotational travel of the blade 1 against cement being troweled causes the trailing edge 2 to be further tightened and to remain tight against the blade 1. Removing the trailing edge 2 is accomplished by pressuring it in the opposite direction to move the bolt head 12 from the high end 32 to the low end 31 such that bolt head 12 can then be removed through bolt-head orifice 15.

Referring to FIGS. 2–7, the angled quick-disconnect channels 18 can be provided with sloped orifice edges 30 having a low end 31 and a high end 32 also. Using both angled and sloped quick-disconnect channels has an advantage of tightening the trailing edge 2 against the bottom of the raised-step aft portion 10 in addition to tightening it against the raised-step contact wall 23. This provides vertical rigidity as well as horizontal rigidity in relationship to contact between the blade 1 and the trailing edge 2.

Figure 15:
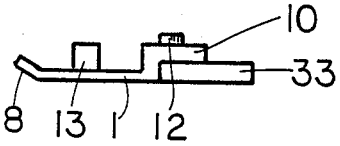
FIG. 15 is an end view of a thickened trailing-edge section for achieving higher wear while yet providing flexibility of a thinner front section of the trowel blade.

Referring to FIG. 15, a thick trailing edge 33 can be utilized to provide longer use-life and a more rigid troweling surface while yet allowing flexibility of the blade 1 in the vicinity of the blade attachment boss 13.

Figure 16:
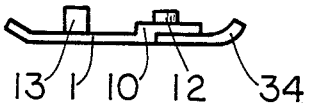
FIG. 16 is an end view of a circular trailing-edge section of the trowel blade.

Referring to FIG. 16, a circular trailing edge 34 can be utilized to provide increased finish smoothness of the cement.

Figure 17:
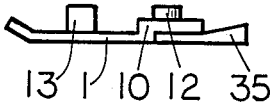
FIG. 17 is an end view of the trailing-edge section with graduated thickness.

Referring to FIG. 17, a graduated-thickness trailing edge 35 can be utilized to provide increased use-life at the highest wear point without additional weight of material for an entire trailing edge.

Figure 18:
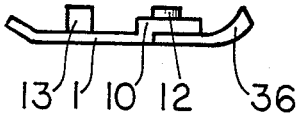
FIG. 18 is an end view of a trailing-edge section with both graduated-thickness and circular surface for enhancing smoothness of finishing and long use-life.

Referring to FIG. 18, a graduated-thickness circular trailing edge 36 can be utilized to increased smoothness with minimal weight of material and to provide also the flexibility of the blade 1 that can aid the trowelling process.

What is claimed is:

1. A replaceable cement-trowel blade that is rectangular with a forward edge, an aft edge, an inside edge and an outside edge and having:

a trowel-blade attachment member attached rigidly to a top surface of the trowel blade;

a means for attachment of the attachment member to a mechanized arm for moving the trowel selectively over the surface of cement to prepare the surface of the cement suitably while it is being dried and otherwise set up for hardening and;

a replaceable trowel-blade trailing-edge that is attachable to the trowel blade at an aft edge of the trowel blade.

2. A replaceable cement-trowel blade according to claim 1 wherein the means for attachment of the attachment member to a mechanized arm is comprised of threaded bolt holes that are sized, formed and positioned to receive bolts from a select variety of different sizes and models of troweling mechanisms.

3. A replaceable cement-trowel blade according to claim 1 and having a means for attachment of the trowel-blade trailing-edge to the aft edge of the trowel blade comprising:

a flat rectangular member attachable over a select portion of an aft surface of the trowel blade and extended selectively aft of the aft edge of the trowel blade and;

a trowel-blade trailing-edge attachable to the flat rectangular member such that the trowel-blade trailing-edge is extended as a replaceable cement-working surface at the aft edge of the trowel blade.

4. A replaceable cement-trowel blade according to claim 1 and having a means for attachment of the trowel-blade trailing-edge to the aft edge of the trowel blade comprising:

a flat rectangular member attached rigidly to a select portion of an aft surface of the trowel blade and extending selectively aft of the aft edge of the trowel blade;

flat-head-countersunk bolt-head and bolt-shaft orifices positioned selectively in a front portion of the trailing-edge;

bolt-shaft orifices positioned in the flat rectangular member to match the bolt-head and bolt-shaft orifices in the trailing-edge and;

bolt heads of flat-head-countersunk bolts attachable rigidly to the flat-head-countersunk bolt-head orifices with bolt shafts extendable through the bolt-shaft orifices in the trailing edge and in the flat rectangular member such that matching fastener nuts can be attached to the bolt shafts at a top surface of the rectangular member without dislodgment and turning of the bolt heads.

5. A replaceable cement-trowel blade according to claim 1 and having a means for attachment of the trowel-blade trailing-edge at an aft edge of the trowel blade comprising:

a raised-step aft portion of the trowel blade sized and shaped to receive the trowel-blade trailing-edge with a bottom surface of the trailing-edge in a plane parallel to the bottom surface of the trowel blade;

flat-head-countersunk bolt-head and bolt-shaft orifices positioned selectively in a bottom surface of a front portion of the trailing edge;

bolt-shaft orifices positioned in the raised-step aft portion of the trowel blade to match the bolt-head and bolt-shaft orifices in the trailing-edge and;

bolt heads of flat-head countersunk bolts attachable rigidly to the flat-head-countersunk bolt-head orifices with bolt shafts extendable through the bolt-shaft orifices in the trailing edge and in the raised-step aft portion of the trowel blade such that matching fastener nuts can be attached to the bolt shafts at a top surface of the raised-step aft portion of the trowel blade without dislodgment and turning of the bolt heads.

6. A replaceable cement-trowel blade according to claim 1 and having a means for attachment of the trowel-blade trailing-edge to the aft edge of the trowel blade comprising:

a raised-step aft portion of the trowel blade sized and shaped to receive the trowel-blade trailing-edge with a bottom surface of the trailing-edge in a plane parallel to the bottom surface of the trowel blade and;

fastener members attachable rigidly to the trailing-edges and extendable through matching fastener-member orifices positioned selectively in the raised-step aft portion of the trowel blade to receive the fastener members such that the fastener members can be secured to maintain the trailing edge rigidly in a position parallel to a bottom surface of the trowel blade.

7. A replaceable cement-trowel blade according to claim 1 and having a means for attachment of the trowel-blade trailing-edge to the aft edge of the trowel blade comprising:

a raised-step aft portion of the trowel blade sized and shaped to receive the trowel-blade trailing-edge with a bottom surface of the trailing-edge in a plane parallel to the bottom surface of the trowel blade;

quick-disconnect bolt heads with quick-disconnect bolt shafts extended rigidly from a top surface of the trailing-edges;

quick-disconnect bolt-head orifices positioned selectively in the raisedstep aft portion of the trowel blade to receive heads of the quick-disconnect bolts attached to a top surface of the trailing-edge and;

quick-disconnect-shaft orifices in the raised-step aft portion of the trowel blade having a parallel straight walls of the said quick-disconnect-shaft orifices at a selectively small angle in relationship to a raised-step contact wall and extending from the quick-disconnect bolt-head orifices to a position sufficiently in the direction of the raised-step contact wall that trailing-edges having such quick-disconnect bolts attached can be held rigidly in place against the aft edge of the trowel blade when the said heads and said shafts of the quick-disconnect bolts are inserted through the bolt-head orifices and the bolt shafts are forced in a direction towards a side edge of the trowel blade and towards the raised-step contact wall simultaneously as a result of the angle of the shaft orifices in relation to the aft edge of the trowel blades.

8. A replaceable cement-trowel blade according to claim 7 wherein the parallel walls of the said bolt-shaft orifices are extended from the said bolt-head orifices to select positions outward radially in relationship to a position from which the trowel blades are attachable to a rotatable cement-trowel machine with the blades in contact with cement in rotational troweling motion, such that rotation of the rotatable cement-trowel machine causes the trailing-edges to tighten in position and the trailing edges can be removed by forcing them in the opposite direction to a position where the said shaft heads are centered in the shaft-head orifices and the fastener heads are forced out through the fastener-head orifices.

9. A replaceable cement-trowel blade according to claim 8 and further comprising:

a selectively upwardly-curved aft end of the trailing-edge.

10. A replaceable cement-trowel blade according to claim 9 and further comprising:

a selectively thick wall of the aft end of the trailing-edge in the vicinity of the upwardly-curved aft end of the trailing-edge.

11. A replaceable cement-trowel blade according to claim 1 and further comprising:

a selectively upwardly-curved aft end of the trailing-edge.

12. A replaceable cement-trowel blade according to claim 1 and further comprising:

a selectively thick wall of the aft end of the trailing-edge in the vicinity of the upwardly-curved aft end of the trailing-edge.

13. A replaceable cement-trowel blade according to claim 1 and having a means for attachment of the trowel-blade trailing-edge to the aft edge of the trowel blade comprising:

a raised-step aft portion of the trowel blade sized and shaped to receive the trowel-blade trailing-edge with a bottom surface of the trailing-edge in a plane selectively in relation to the bottom surface of the trowel blade;

quick-disconnect bolt heads with shafts extended rigidly from a top surface of the trailing-edges;

quick-disconnect bolt-head orifices positioned selectively in the raisedstep aft portion of the trowel blade to receive heads of the quick-disconnect bolts attached to a top surface of the trailing-edge;

quick-disconnect bolt-shaft orifices in the raised-step aft portion of the trowel blade having parallel straight walls of the said shaft orifices parallel to a raised-step contact wall of the of the trowel blade and positioned at a select distance from the said contact wall aft edge of the trowel blade to cause the raised-step contact wall to fit snugly against a front edge of the trailing-edge when the quick-disconnect-bolt shafts are positioned inside of the shaft orifices and;

a top surface of the raised-step aft portion of the trowel blade increasing in thickness selectively from the position of each bolt-head orifice to the vicinity of the terminal end of each bolt-shaft orifice such that the trailing-edge is tightened in rigid contact with the raised-step aft portion of the trowel blade when the quick-disconnect bolt heads are inserted through the bolthead orifices and the bolt shafts are forced in the direction of the increased thickness of the tops surface of the raised-step aft portion of the trowel blade.

14. A replaceable cement-trowel blade according to claim 13 wherein the parallel walls of the quick-disconnect bolt-shaft orifices are extended from the quick-disconnect bolt-head orifices to select positions outward radially in relationship to a position at which the trowel blades are attachable to a rotatable cement-trowel machine, such that rotation of the rotatable cement-trowel machine causes the trailing-edges to tighten in position and the trailing edges can be removed by forcing them in the opposite direction to a position where the said bolt heads are centered in the fastener-head orifices and the sad bolt heads are forced out through the said quick-disconnect bolt-head orifices.

15. A replaceable cement-trowel blade according to claim 14 and further comprising:

a selectively upwardly-curved aft end of the trailing-edge.

16. A replaceable cement-trowel blade according to claim 15 and further comprising:

a selectively thick wall of the aft end of the trailing-edge in the vicinity of the upwardly-curved aft end of the trailing-edge.

17. A replaceable cement-trowel blade according to claim 1 and having a means for attachment of the trowel-blade trailing-edge to the aft edge of the trowel blade comprising:

a raised-step aft portion of the trowel blade sized and shaped to receive the trowel-blade trailing-edge with a bottom surface of the trailing-edge in a plane selectively in relation to the bottom surface of the trowel blade;

a selectively thick portion of the trowel blade to provide selective rigidity and strength in the vicinity of the raise-step aft portion of the trowel blade and;

fastener members attachable rigidly to the trailing-edges and extendable through matching fastener-member orifices positioned selectively in the raisedstep aft portion of the trowel blade to receive the fastener members such that the fastener members can be secured to maintain the trailing edge rigidly in a select position.

18. A replaceable cement-trowel blade according to claim 1 and having a means for attachment of the trowel-blade trailing-edge to the aft edge of the trowel blade comprising:

a raised-step aft portion of the trowel blade sized and shaped to receive the trowel-blade trailing-edge with a bottom surface of the trailing-edge in a plane parallel to the bottom surface of the trowel blade;

quick-disconnect bolt heads with quick-disconnect bolt shafts extended rigidly from a top surface of the trailing-edges;

quick-disconnect bolt-head orifices positioned selectively in the raised-step aft portion of the trowel blade to receive heads of the quick-disconnect bolts attached to a top surface of the trailing-edge;

quick-disconnect-shaft orifices in the raised-step aft portion of the trowel blade having parallel straight walls of the said quick-disconnect-shaft orifices at a selectively small angle in relationship to a raised-step contact wall of the trowel blade and extended from the quick-disconnect bolt-head orifices to a position sufficiently in the direction of an aft edge of the trowel blade and outward radially from a point of contact of the trowel blade with a rotary cement-troweling machine that trailing-edges having such quick-disconnect bolts attached can be held rigidly in place against the raised-step contact wall of the trowel blade when the said heads and said shafts of the quick-disconnect bolts are inserted through the bolt-head orifices and the bolt shafts are forced in a direction towards a blade outside edge and towards the raised-step contact wall simultaneously as a result of the angle of the shaft orifices in relation to the aft edge of the trowel blades and as a result of outwardly radially rotational movement of the blades against cement surfaces being troweled and;

a top surface of the raised-step aft portion of the trowel blade increasing in thickness selectively from the position of each bolt-head orifice to the vicinity of the terminal end of each bolt-shaft orifice such that the trailing-edge is tightened in rigid contact with a bottom surface of the raised-step aft portion of the trowel blade when the quick-disconnect bolt heads are inserted through the bolt-head orifices and the bolt shafts are forced in the direction of the increased thickness of the top surface of the raised-step aft portion of the trowel blade simultaneously with being forced in the direction of the raised-step contact wall of the trowel blade.

* * * * *